United States Patent [19]

Ferrari et al.

[11] Patent Number: 4,911,445

[45] Date of Patent: Mar. 27, 1990

[54] VIBRATION DAMPENING DEVICE FOR A SPORTS RACKET HAVING A STRUNG STRIKING SURFACE

[75] Inventors: Harry M. Ferrari; John M. Shallenberger, both of Pittsburgh, Pa.

[73] Assignee: Ferrari Importing Company, Pittsburgh, Pa.

[21] Appl. No.: 303,781

[22] Filed: Jan. 27, 1989

[51] Int. Cl.[4] ..... A63B 51/00

[52] U.S. Cl. ..... 273/73 D; 273/73 R

[58] Field of Search ..... 273/73 R, 73 C, 73 D, 273/29 R

[56] References Cited

U.S. PATENT DOCUMENTS

| | | | |
|---|---|---|---|
| 2,732,209 | 1/1956 | Forbes | 273/73 |
| 3,874,666 | 4/1975 | Ross | 273/73 R |
| 4,180,265 | 12/1979 | Staufer | 273/73 D |
| 4,291,574 | 9/1981 | Frolow | 73/65 |
| 4,499,144 | 2/1985 | van Rijswijk | 273/73 R X |
| 4,575,083 | 3/1986 | Adam | 273/73 D |
| 4,589,662 | 5/1986 | Robaldo | 273/73 D |
| 4,609,194 | 9/1986 | Krent et al. | 273/73 D |
| 4,732,383 | 3/1988 | Ferrari et al. | 273/73 D |
| 4,761,007 | 8/1988 | Boschian | 273/73 D |

FOREIGN PATENT DOCUMENTS

| | | | |
|---|---|---|---|
| 3123690 | 3/1983 | Fed. Rep. of Germany | 273/73 R |
| 3324142 | 1/1985 | Fed. Rep. of Germany . | |
| 3504137 | 8/1986 | Fed. Rep. of Germany . | |
| 1398833 | 9/1965 | France . | |
| 2582224 | 11/1986 | France . | |
| 2585256 | 1/1987 | France . | |
| 2135588 | 9/1984 | United Kingdom | 273/73 D |
| 8802271 | 9/1987 | World Int. Prop. O. | 273/73 D |
| 8901809 | 8/1988 | World Int. Prop. O. | 273/73 D |

OTHER PUBLICATIONS

"Tennis Tech" by Neil Amdur, Aug. 1987.

*Primary Examiner*—Edward M. Coven
*Assistant Examiner*—William E. Stoll
*Attorney, Agent, or Firm*—Michael R. Swartz; John R. Flanagan

[57] ABSTRACT

A device for dampening vibrations in a sports racket having a strung striking surface includes an elongated elastic flexible hollow tubular member disposable in interweaved relation with a plurality of strings on the racket striking surface, and inelastic end members on the opposite ends of the tubular member for securing the tubular member in a stretched condition between its opposite ends to a pair of spaced strings and for retaining the member in the interweaved relation with the plurality of strings. The hollow tubular member defines a central bore having opposite openings at the opposite ends of the member. Each inelastic end member includes an inner element having a stem portion inserted within one opposite end opening for attachment in frictional interfitting relation with one end of the elastic tubular member, and an outer hook-like element for anchoring the one opposite end of the elastic member to one of the pair of strings. The outer hook-like element is rigidly connected to a cover portion of the inner element which engages an outer end surface of the tubular member end when the stem portion is inserted into the one tubular member end openings. A viscoelastic energy damping medium is encapsulated within the central bore of the elastic hollow tubular member by the end members.

18 Claims, 2 Drawing Sheets

VIBRATION DAMPENING DEVICE FOR A SPORTS RACKET HAVING A STRUNG STRIKING SURFACE

BACKGROUND OF THE INVENTION

1. Field of the Invention

The present invention generally relates to vibration dampening in a sports racket having a strung striking surface and, more particularly, is concerned with a resilient viscoelastic tubular strap-like device for dampening vibrations and absorbing shock in the strings and frame of a sports racket.

2. Description of the Prior Art

A conventional strung sports racket has a striking surface formed by two intersecting sets of parallel spaced strings attached to and enclosed by an oval-shaped head portion of the racket. One set of strings run longitudinally or generally parallel to a handle of the racket, whereas the other set of strings run transversely or generally normal to the racket handle. In such a racket, vibrations are typically produced in the strung surface when the playing object of the game is struck, such as a ball used in the game of tennis.

These vibrations are believed to be at least one, if not the major, cause of conditions of arm and shoulder pain and discomfort and tennis elbow suffered by many avid tennis players. The strings of the racket transmit the vibrations to the head portion of the racket frame surrounding and holding the strings. The head portion, in turn, transmits the vibrations to the handle portion of the racket frame and then to the arm of the player. It has long been considered desirable to reduce such vibrations in order to reduce their deleterious effects on the player.

Many devices are known in the prior art for dampening vibrations. Representative of the vibration dampening devices are the ones disclosed in U.S. patents to Forbes (2,732,209), Staufer (4,180,265), Robaldo (4,589,662), Krent et al (4,609,194) and Ferrari et al (4,732,383); published German patent documents DE No. 3324142 A1 and DE No. 3504137 Al; and published French patent documents Nos. 1,398,833; 2,582,224; and 2,585,256. The devices of the prior art suffer from one or more drawbacks. Some are too bulky. Others tend to pop out during play. Still others tend to wear out too soon.

Consequently, in view of the above-described shortcomings, a need still exists for another approach to vibration dampening of a sports racket and its strung striking surface.

SUMMARY OF THE INVENTION

The present invention provides a vibration dampening device designed to satisfy the aforementioned needs. More particularly, the present invention relates to a resilient viscoelastic tubular strap-like device for dampening vibrations and absorbing shock in the strings and frame of a sports racket and thereby reducing transmission to the arms and shoulders of users. The device contacts multiple longitudinal strings of the racket to obtain a more effective dampening characteristic. Also, by being elastic, or stretchable, and having opposite end hooks, the device is simple and easy to secure on the strings of the racket and to retain thereon during play. Further, the device creates a more solid feel for all types of shots with the racket and is virtually indestructible.

Accordingly, the present invention is directed to a device for dampening vibrations in a sports racket having sets of interweaved strings defining a striking surface thereof. The vibration dampening device comprises: (a) an elongated elastic flexible hollow tubular member having opposite ends and being disposable in an interweaved relation between a plurality of the strings of the sets thereof defining the racket striking surface; and (b) means on the opposite ends of the tubular member for securing the member in a stretched condition between its opposite ends to a pair of spaced strings of the plurality thereof and for retaining the member in the interweaved relation with the plurality of strings on the racket striking surface. The hollow tubular member defines a central bore having opposite openings at the opposite ends of the member. The securing means is in the form of a pair of inelastic end members. Each inelastic end member includes an inner element attached in a frictional interfitting relation with one of the opposite ends of the elastic tubular member and an outer element for anchoring the one end of the elastic member to one of the pair of strings.

More particularly, the inner element of each end member is an end cap having an inner stem portion and an outer cover portion rigidly connected to one another. The stem portion has a maximum outside diameter larger than the inside diameter of the bore opening of the one opposite end of the elastic tubular member, thus requiring radial elastic expansion of the tubular member end for allowing insertion of the stem portion therein. The stem portion also has an inner tapered section for forcing such radial elastic expansion of the tubular member end upon forcible insertion of the stem portion within the tubular member end opening.

The cover portion of the end cap or inner element of the end member has an outside diameter greater than the maximum diameter of the stem portion and the inside diameter of the bore opening and is engagable with an end surface on the tubular member end when the stem portion is inserted within the tubular member end opening. The stem portion of the end cap further has at least one and preferably a pair of circumferential grooves defined thereabout and located between the inner tapered section of the stem portion and the cover portion of the end cap. The groove has an outside diameter less than the maximum diameter of the stem portion which permits contraction of annular portions of the stretched opposite end of the tubular member into the grooves for providing the frictional interfitting relation between the stem portion of the inner element and the tubular member end. The outer element of the end member is configured in the shape of a hook and is rigidly attached to and extends outwardly from the cover portion of the inner element of the end member.

The vibration dampening device of the present invention also includes a viscoelastic energy damping medium encapsulated within the central bore of the elastic hollow tubular member by the end caps of the end members. The medium is a material which is capable of absorbing the energies which produce the vibrations in the racket striking surface. The medium absorbs the energies at a wider frequency band than foam and solid rubber devices of the prior art devices.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
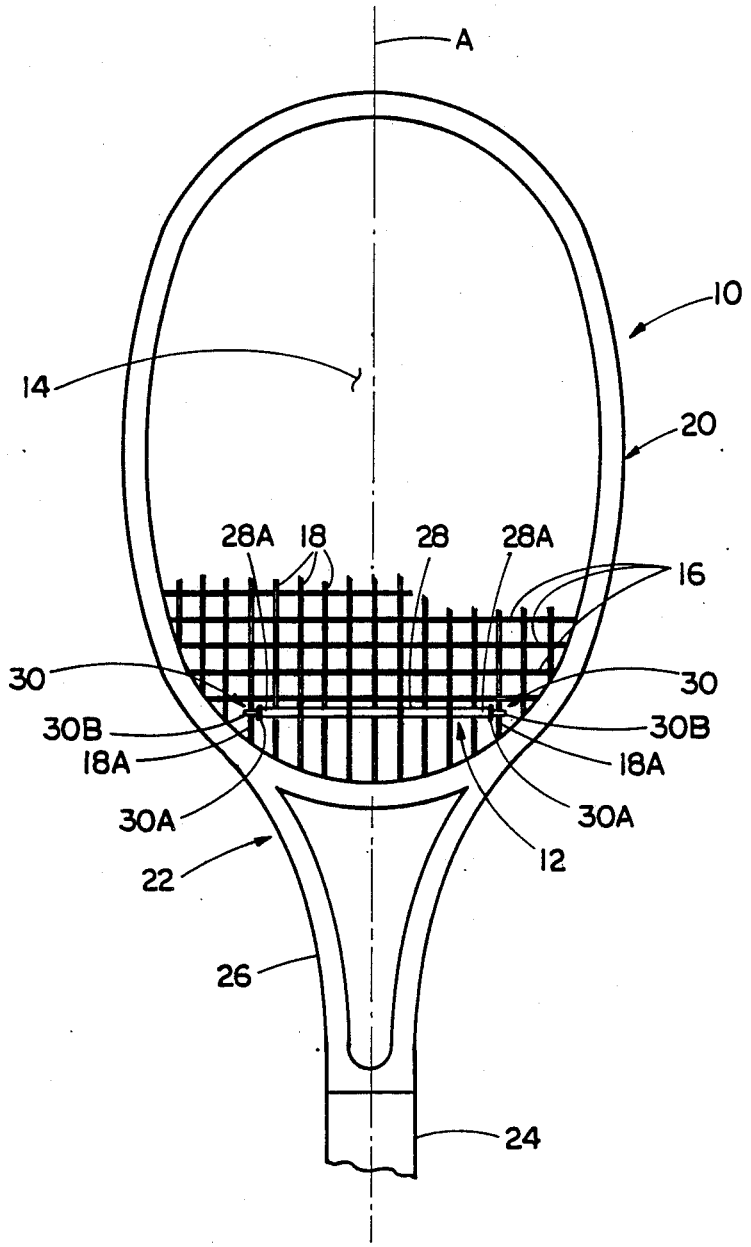
FIG. 1 is a fragmentary plan view of a tennis racket having a partially shown strung striking surface mounting a vibration dampening device in accordance with the present invention.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is shown a tennis racket, generally indicated by the numeral 10, having attached thereon a vibration dampening device 12 constructed in accordance with the principles of the present invention. While the vibration dampening device 12 of the present invention is illustrated and described in conjunction with a tennis racket, it is believed to be applicable to the rackets used in playing other sports comparable to tennis. Therefore, the reference to a tennis racket should be construed in a generic sense.

The tennis racket 10 per se is of conventional construction having a strung striking face or surface 14 composed of first and second sets of strings 16, 18. The strings 16 of the first set are spaced apart and extend generally parallel to one another and are oriented transverse to the longitudinal axis A of the racket 10. The strings 18 of the second set are spaced apart and extend generally parallel to one another and are oriented parallel to the longitudinal axis of the racket. Both sets of transverse and longitudinal strings 16, 18 criss-cross one another at right angles and are interwoven with each other. They extend between and are attached under tension on an oval-shaped head portion 20 of the racket frame 22. The head portion 20 of the racket frame 22 is interconnected to a handle 24 via a throat portion 26 thereof.

Figure 2:
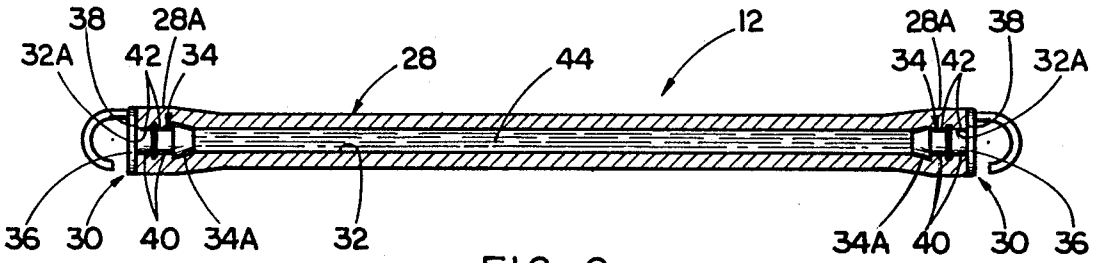
FIG. 2 is an enlarged longitudinal axial sectional view of the device of FIG. 1 removed from the tennis racket.
Figure 3:
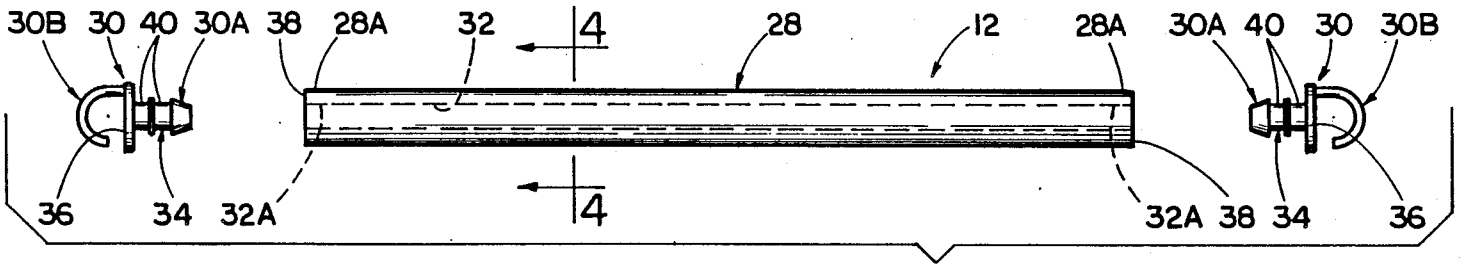
FIG. 3 is an exploded side elevational view of the device of FIG. 2.
Figure 4:
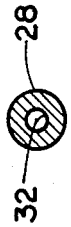
FIG. 4 is a cross-sectional view of the device taken along line 4—4 of FIG. 3.

Turning now to FIGS. 2–4, the vibration dampening device 12 of the present invention is illustrated removed from the racket 10. The device 12 is capable of dampening vibrations in the sets of interleaved strings 16, 18 defining the striking surface 14 and ultimately in the frame 22 of the racket 10. In its basic parts, the vibration dampening device 12 includes an elongated elastic flexible hollow tubular member 28 of cylindrical configuration and a pair of inflexible end members 30 secured on the opposite ends 28A of the elastic hollow tubular member 28. The flexibility and elasticity of the hollow tubular member 28 allows disposability of the member 28 in an interweaved relation, as shown in FIG. 1, between a plurality of the longitudinal strings 18 and preferably spaced below the lowermost one of the transverse strings 16. The end members 30 are attached on the opposite ends 28A of the tubular member 28 for use in securing the member 28 in a stretched condition between its opposite ends 28A, as seen in FIG. 1, to a pair of spaced longitudinal strings 18A of the plurality thereof and for retaining the member 28 in the interweaved relation with the plurality of strings 18 on the racket striking surface 14. One suitable material from which to fabricate the tubular member 28 is translucent silicone tubing. The end members 30 can be fabricated from a suitable relatively rigid lightweight material, such as ABS plastic.

The hollow tubular member 28 of the vibration dampening device 12 defines a central bore 32 having opposite openings 32A at the opposite ends 28A of the member 28. Further, each inelastic end member 30 includes an inner element 30A attached in a frictional interfitting relation with one of the opposite ends 28A of the elastic tubular member 28 and an outer element 30B for anchoring the one end 28A of the elastic member 28 to one of the pair of strings 18A.

The inner element 30A of each inelastic end member 30 is an end plug or cap having an inner stem portion 34 and an outer cover portion 36 rigidly connected to one another. As is readily apparent in FIG. 2, the stem portion 34 of the inner element 30A of each end member 30 has a maximum outside diameter larger than the inside diameter of the bore opening 32A of each end 28A of the elastic tubular member 28 receiving the respective stem portion. Thus, radial elastic expansion of each tubular member end 28A is required in order to allow insertion of the respective stem portion 34 therein. For purposes of forcing such radial elastic expansion of the tubular member end 28A as depicted in FIG. 2, the stem portion 34 has an inner tapered section 34A which facilitates insertion of the stem portion 34 within the tubular member end opening 32A.

As also shown in FIGS. 2 and 3, the outer cover portion 36 of the inner element 30A of each end member 30 has a circular disk-shaped configuration and an outside diameter greater than the maximum diameter of the respective inner stem portion 34 and the inside diameter of the respective bore opening 32A. Each cover portion 36 seats in engagement against an annular end surface 38 on each of the tubular member ends 28A once the respective stem portion 34 is inserted within the tubular member end opening 32A.

The inner stem portion 34 also has a pair of circumferential grooves 40 defined thereabout and located between the inner tapered section 34A of the stem portion 34 and the cover portion 36 of the inner element 30A of each end member 30. Each groove 40 has an outside diameter less than the maximum diameter of the stem portion 34 which permits contraction of an annular portion 42 of the stretched opposite end 28A of the tubular member 28 into the groove 40 for providing the friction interfitting relation between the stem portion 34 of the inner element 30A and the tubular member end 28A.

As mentioned above, the outer element 30B of each end member 30 anchors one end 28A of the elastic member 28 to one of the pair of strings 18A. For this purpose, as seen in FIGS. 2 and 3, the outer element 30B is configured in the shape of a hook and is integrally rigidly attached to and extends outwardly from the cover portion 36 of the inner element 30A.

Finally, the vibration dampening device 12 also preferably includes a viscoelastic energy damping medium 44. The medium 44 is encapsulated within the central bore 32 of the elastic hollow tubular member 28 by the end caps or inner elements 30A of the end members 30. The medium 44 is a material designed to absorb energies which produce the vibrations in the racket striking surface 14. Other materials, liquid or solid, can be used. Alternatively, the elastic member 28 can be solid.

It should be apparent that the tubular member 28 is preferably in a slightly stretched condition when secured to the racket 10. Over-stretching can reduce the dampening effect of the device 12. However, only a minimum of stretching is necessary to retain the device 12 on the racket during use so loss of dampening effect due to stretching is minimal.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. A device for dampening vibrations in a sports racket having sets of interweaved strings defining a striking surface thereof, said device comprising:

(a) an elongated tubular member composed of elastic flexible material and having opposite ends, said tubular member being at least partially hollow so as to define a central bore within at least a portion of said tubular member located between said opposite ends thereof, said tubular member being disposable in an interweaved relation between a plurality of the strings of the sets thereof defining the racket striking surface;

(b) means attached on said opposite ends of said tubular member for securing said member, in a stretched condition between its opposite ends, to a pair of spaced strings of the plurality thereof and for retaining said member in said stretched condition and in said interweaved relation with the plurality of strings on the racket striking surface, said securing means being in the form of a pair of end members being attached on said opposite ends of said tubular member; and (c) a vibration damping medium separate from that of said tubular member and encapsulated by said tubular member within said central bore thereof.

2. A device for dampening vibrations in a sports racket having sets of interweaved strings defining a striking surface thereof, said device comprising:

(a) an elongated tubular member composed of elastic flexible material and having opposite ends, said tubular member being at least partially hollow so as to define a central bore within at least a portion of said tubular member located between said opposite ends thereof, said tubular member being disposable in an interweaved relation between a plurality of the strings of the sets thereof defining he racket striking surface; and (b) means attached on said opposite ends of said tubular member for securing said member in a stretched condition between its opposite ends, to a pair of spaced strings of the plurality thereof and for retaining said member in said stretched condition and in said interweaved relation with the plurality of strings on the racket striking surface, said securing means being in the form of a pair of end members composed of substantially inelastic material and being separate from and attached on said opposite end s of said member, each said end member including (i) an inner element attached with a respective one of said opposite ends of said tubular member, and (ii) an outer element connected to said inner element and extending therefrom beyond said respective one opposite end of said tubular member, said outer element being configured for anchoring to one of the pair of strings.

3. The device as recited in claim 2, wherein said inner element of each end member has an inner stem portion inserted into an opening in said respective one opposite end of said tubular member in a frictional interfitting relation with said one opposite end thereof, said inner element also having an outer cover portion rigidly connected to said inner stem portion and disposed outwardly of said respective one opposite end of said tubular member.

4. The device as recited in claim 3, said outer element of said each end member is configured in the shape of a hook and is rigidly attached to and extends outwardly from said cover portion of said inner element.

5. The device as recited in claim 3, wherein said stem portion has a maximum outside diameter larger than an inside diameter of said opening of said one opposite end of said tubular members, thus requiring radial elastic expansion of said tubular member end for allowing insertion of said stem portion therein.

6. The device as recited in claim 5, wherein said cover portion has an outside diameter greater than said maximum diameter of said stem portion and said inside diameter of said opening and is engagable with an end surface on said one tubular member end when said stem portion is inserted within said one tubular member end opening.

7. The device as recited in claim 5, wherein said stem portion also has an inner tapered section for forcing such radial elastic expansion of said tubular member end upon forcible insertion of said stem portion within said one tubular member end opening.

8. The device as recited in claim 5, wherein said stem portion further has at least one circumferential groove defined thereabout and located between the inner tapered section thereof and said cover portion of said end member.

9. The device as recited in claim 8, wherein said groove has an outside diameter less than said maximum diameter of said stem portion which permits contraction of an annular portion of the stretched opposite end of the tubular member into said groove for providing said friction interfitting relation between said stem portion of said inner element and said tubular member end.

10. A device for dampening vibrations in a sports racket having sets of interweaved strings defining a striking surface thereof, said device comprising:

(a) an elongated tubular member composed of elastic flexible material and having opposite ends, said tubular member being at least partially hollow so as to define a central bore within at least a portion of said tubular member located between said opposite ends thereof, said tubular member being disposable in an interweaved relation between a plurality of the strings of the sets thereof defining the racket striking surface;

(b) means attached on said opposite ends of said tubular member for securing said member to a pair of spaced strings of the plurality thereof and for retaining said members in said interweaved relation with the plurality of strings on the racket striking surface, said securing means being in the form of a pair of end members composed of substantially inelastic material and being separate from and attached on said opposite ends of said tubular member; and (c) a vibration damping medium separate from said tubular member and encapsulated by said tubular member within said central bore thereof.

11. The device as recited in claim 10, wherein each inelastic end member includes:

an inner element attached with a respective one of said opposite ends of said tubular member; and an outer element connected to said inner element and extending therefrom beyond said respective one opposite end of said tubular member, said outer element being configured for anchoring to one of the pair of strings.

12. The device as recited in claim 11, wherein said inner element of each end member has an inner stem portion inserted into an opening in said respective one opposite end of said tubular member in a frictional interfitting relation with said one opposite end thereof, said inner element also having an outer cover portion rigidly connected to said inner stem portion and disposed outwardly of said respective one opposite end of said tubular member.

13. The device as recited in claim 12, said outer element of said each end member is configured in the shape of a hook and is rigidly attached to and extends outwardly from said cover portion of said inner element.

14. The device as recited in claim 12, wherein said stem portion has a maximum outside diameter larger than an inside diameter of said opening of said one opposite end of said tubular member, thus requiring radial elastic expansion of said tubular member end for allowing insertion of said stem portion therein.

15. The device as recited in claim 14, wherein said cover portion has an outside diameter greater than said maximum diameter of said stem portion and said inside diameter of said opening and is engagable with an end surface on said one tubular member end when said stem portion is inserted within said one tubular member end opening.

16. The device as recited in claim 14, wherein said stem portion also has an inner tapered section for forcing such radial elastic expansion of said tubular member end upon forcible insertion of said stem portion within said one tubular member end opening.

17. The device as recited in claim 16, wherein said stem portion further has a pair of circumferential grooves defined thereabout and located between the inner tapered section thereof and said cover portion of said end member.

18. The device as recited in claim 17, wherein each of said grooves has an outside diameter less than said maximum diameter of said stem portion which permits contraction of an annular portion of the stretched opposite end of the tubular member into said groove for providing said friction interfitting relation between said stem portion of said inner element and said tubular member end.

* * * * *